US005618051A

United States Patent [19]

Kobylenski et al.

[11] Patent Number: 5,618,051

[45] Date of Patent: Apr. 8, 1997

[54] ARTICULATED TWO-SECTION SNOWBOARD

[76] Inventors: Mark J. Kobylenski, 62 Eli Bunker Rd., Goshen, Conn. 06756; David M. Dupill, 58 Parker Hill Rd., Norfolk, Conn. 06058

[21] Appl. No.: 658,505

[22] Filed: Jun. 5, 1996

[51] Int. Cl.[6] ..... B62B 13/04

[52] U.S. Cl. ..... 280/14.2; 280/15; 280/16; 280/17; 280/20; 280/22; 280/603; 280/606; 441/65

[58] Field of Search ..... 280/14.2, 20, 845, 280/15, 16, 17, 22, 603, 601, 606, 607, 87.041, 87.042; 441/74, 68, 65

[56] References Cited

U.S. PATENT DOCUMENTS

| | | | |
|---|---|---|---|
| 2,390,181 | 12/1945 | Sarthou | 280/606 |
| 3,372,944 | 3/1968 | Lauritzen | 280/20 |
| 4,076,267 | 2/1978 | Lipscomb | 280/87.042 |
| 4,082,306 | 4/1978 | Sheldon | 280/87.042 |
| 4,243,238 | 1/1981 | Johnson | 280/20 |
| 5,411,282 | 5/1995 | Shannon | 280/606 |
| 5,540,455 | 7/1996 | Chambers | 280/87.041 |

FOREIGN PATENT DOCUMENTS

| | | | |
|---|---|---|---|
| 362782 | 4/1990 | European Pat. Off. | 280/14.2 |
| 116434 | 5/1946 | Sweden | 280/606 |

*Primary Examiner*—Eric D. Culbreth

[57] ABSTRACT

An articulated two-section snowboard includes separate front and rear sections joined together for articulation and oscillation, each section having a binding for one foot. In a preferred embodiment, the joint between the two sections is achieved by one or more flexible straps. The front end of the strap being attached to the rear end of the front section and the rear end of the strap being attached to the front of the rear section, the strap preferably passes through openings formed for the purpose in the front of the rear section. A spacer may be provided to keep the rear section from riding up over the front section, and a quick-connect and disconnect latch may be provided to separate the sections for purposes of storage or replacement of a section.

2 Claims, 4 Drawing Sheets

ARTICULATED TWO-SECTION SNOWBOARD

FIELD OF THE INVENTION

This invention relates to a snowboard comprising of independent front and back sections joined together in a universal fashion to permit relative axial oscillation and horizontal and vertical pivoting of the sections.

BACKGROUND OF THE INVENTION

In the past, prior snowboards have comprised of a single surface, with upwardly curved tips on each end having various degrees of width and rigidity. Such a snowboard has been equipped with forward and rear bindings for attaching the user's boots to said snowboard.

Prior snowboards have been limited in the ability to make sharp turns and to smoothly proceed over uneven surface. The rigid elongated nature of prior snowboards has made it awkward to store and transport and also limits the user in tricks or aerial acrobatics. When utilizing a chair lift, prior rigid snowboards tend to angle off to one side, intruding into the space and skis of co-passengers. The rigidity of prior snowboards also presents a challenge to the user in returning to an upright position in the event the said user should fall.

All of the above mentioned disadvantages are addressed by the articulated two-section snowboard.

SUMMARY OF THE INVENTION

The articulated two-section snowboard relates to a snowboard comprising of separate front and rear sections pivotally joined together for articulation and oscillation, with each section having a binding for one foot. In a preferred embodiment, the joint between the two sections is achieved by one or more flexible straps, the front end of a strap being attached to the rear end of the front section and the rear end of said strap being attached to the front end of the rear section. A spacer may be attached to the strap to prevent the rear section from riding up over the front section. Quick connect and disconnect latches may be provided to separate the sections for purposes of storage, transportation, mobility or replacement of a section.

BRIEF DESCRIPTION OF THE DRAWINGS

Further objects and features of the articulated two-section snowboard will be clear to those skilled in the art, from a review of the following specifications and drawings, all of which present a non-limiting form of the articulated two-section snowboard. In the drawings.

DESCRIPTION OF THE PREFERRED EMBODIMENT

Figure 1:
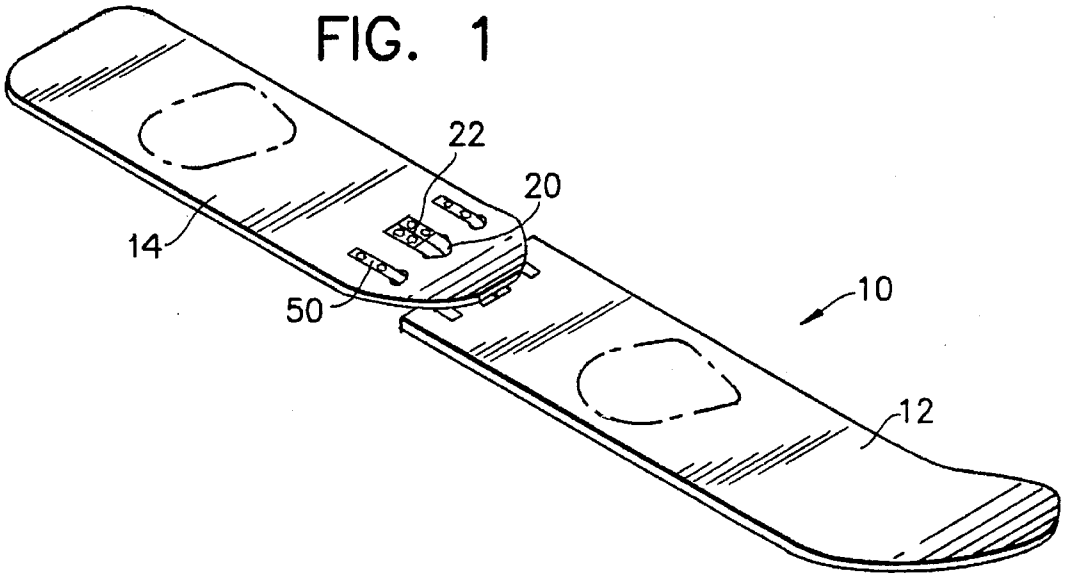
FIG. 1 is a perspective view of the preferred embodiment of the articulated two-section snowboard, showing in phantom, the areas on which bindings may be mounted.

A articulated two-section snowboard is shown in FIG. 1 and generally designated 10. It comprises a front section 12 and a rear section 14. As shown in FIG. 1, the front tip of the front section is curved upwardly in the manner of a conventional snowboard tip. The front tip of the rear section is curved upwardly as shown in FIG. 4, but not to the extent of the front section tip.

As shown in FIG. 1, the rear section has a rounded triangular opening as generally designated 20 on the center line of said rear section. Extending through the opening 20 is a central connecting strap 22. The ends of strap 22 are attached respectively to the front and rear sections. Strap 22, would be preferably of a natural rubber and may have the thickness of about ¼" or better.

Figure 4:
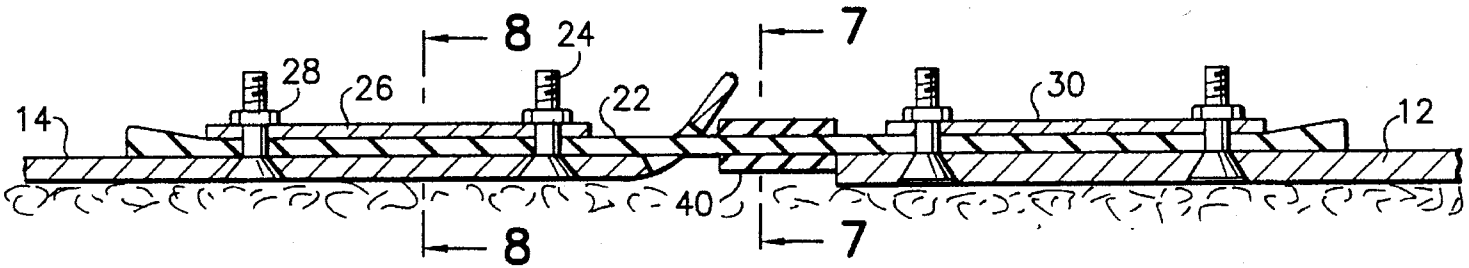
FIG. 4 is an enlarged fragmentary sectional view taken on the line 4—4 of FIG. 2.

Strap 22 as shown in FIG. 4 is substantially non-rigid and secured to the respective sections of the articulated two-section snowboard by flat-head bolts 24 which are preferably molded into said snowboard to achieve a smooth surface. Bolts 24 extend through apertures in strap 22 and receive respective openings of a rear clamping plate 26 which is perforated at opposite ends of said plate 26. A nut 28 is threaded onto bolt 24 to compress strap 22 between plate 26 and rear section 14 of the articulated snowboard in a secured fashion.

Figure 7:
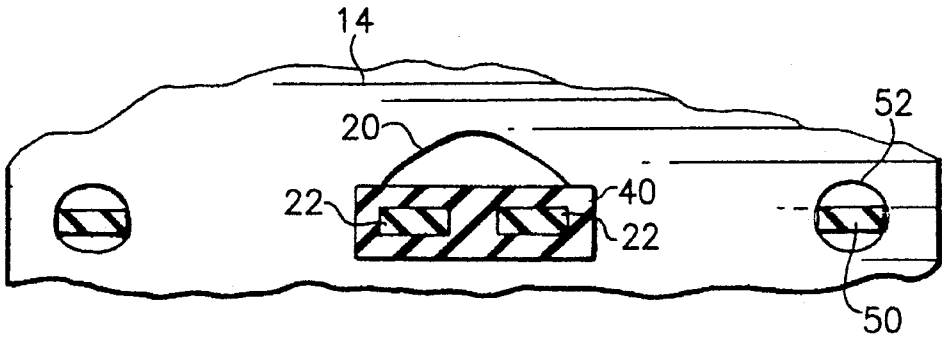
FIG. 7 is a fragmentary sectional view taken on the line 7—7 of FIG. 4.
Figure 8:
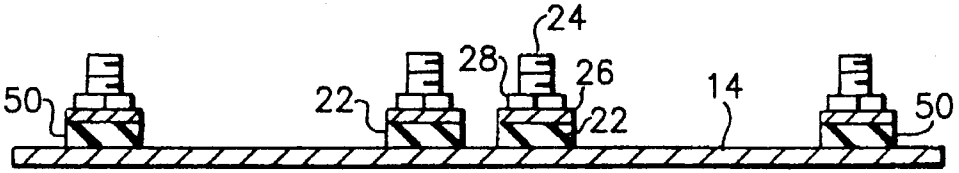
FIG. 8 is a sectional view taken on the line 8—8 of FIG. 4.

FIG. 4 shows a front clamping plate 30, attached with bolt 24 which is molded into the rear of the front section of the articulated two-section snowboard. Plate 30 clamps strap 22 as shown. A tubular spacer 40 is provided. Preferably, as shown in FIG. 7, spacer 40 has an opening for strap 22. Spacer 40 may be of resilient plastic or rubber and can engage with its opposite ends, the adjacent portions of the front and rear sections. Spacer 40 attempts to keep the rear section of the articulated two-section snowboard from riding up over the front section.

Figure 2:
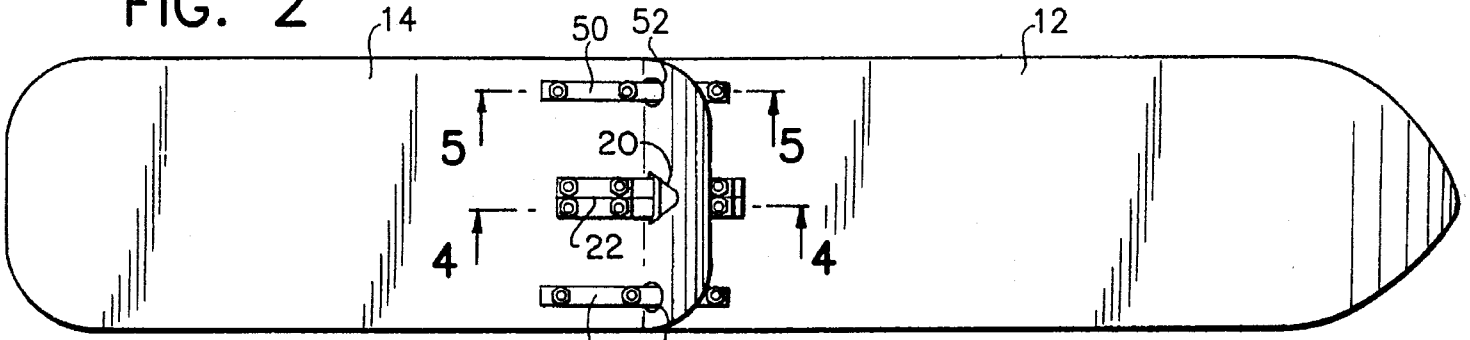
FIG. 2 is a top view plan.
Figure 3:
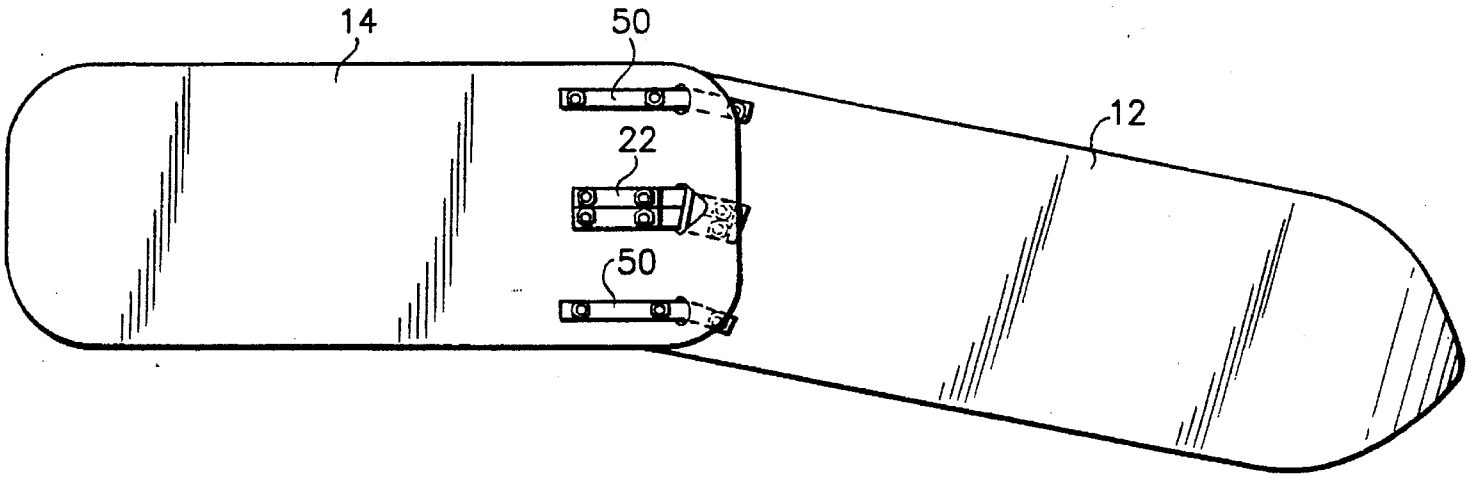
FIG. 3 is a plan view of a articulated two-section snowboard as it would appear while carving a turn.
Figure 5:
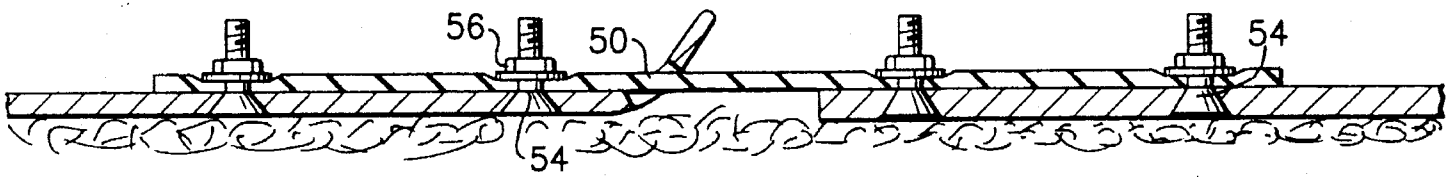
FIG. 5 is a sectional view taken on the line 5—5 of FIG. 2.

As shown in FIG. 2 longitudinal side connecting straps 50 are provided in the preferred embodiment and pass through openings 52, respectively along lines spaced outward from strap 22. Straps 50, as shown in FIG. 5, have the forward and rearward ends firmly secured to the front and rear sections of the snowboard respectively. As shown in FIG. 5, bolts 54 are preferably molded into the proximal ends of the front and rear sections of the snowboard. A nut 56 (FIG. 5) carrying a washer would be tightened to clamp straps 50 between the various points to properly secure said straps 50. The purpose of straps 50 and strap 22 are foremost to connect the front and rear sections, with an added feature of dexterity.

Figure 9:
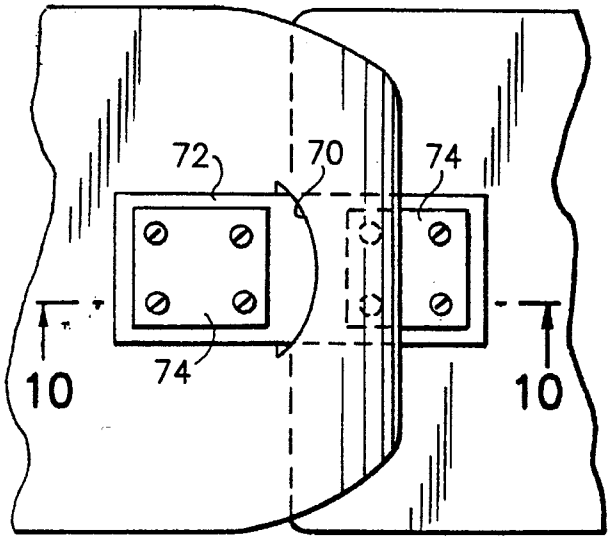
FIG. 9 is a fragmentary view of a modified connection between the from and rear sections.

A further embodiment of the articulated two-section snowboard is shown in FIG. 9 wherein the opening 70, in the tip of the rear section, is enlarged and receives a broad connecting strap 72, clamped to the respective front and rear sections at its opposite ends by top clamping plates 74. Strap 72 provides further flexibility for the accomplished and extreme snowboard user. The FIG. 1 embodiment is preferred in that desirable flexibility of the connecting joint can be achieved with control of the extent of pivoting.

Figure 11:
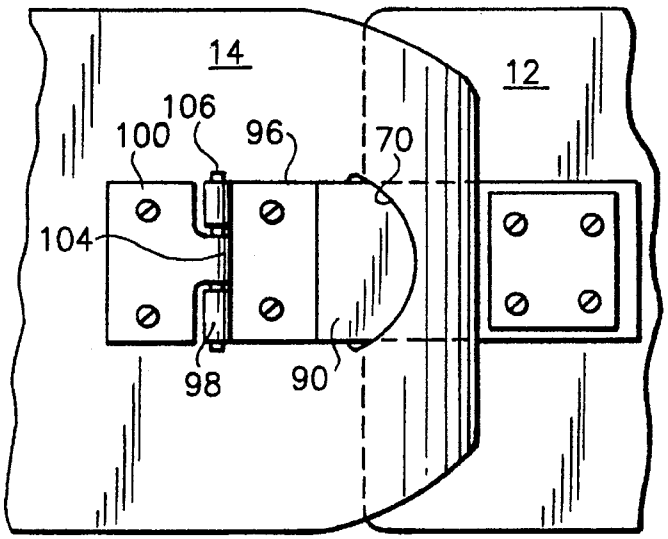
FIG. 11 is a fragmentary view of a further modification.
Figure 10:
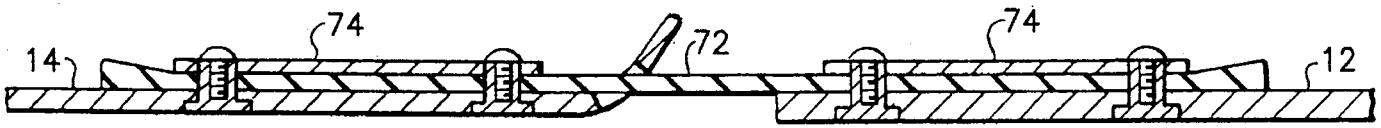
FIG. 10 is an enlarged fragmentary sectional view taken on the line 10—10 of FIG. 9.

The FIG. 11 modification includes means for quick-detachment and quick-attachment of the sections. In FIG. 11, strap 90 passes through opening 70. Strap 90 is secured to the rear of the front section by a plate which is functionally equivalent to plate 74, shown in FIGS. 9 and 10, and fasteners similar to that of the FIG. 9 embodiment. As shown in FIG. 11, the rear end of strap 90 is secured to a hinge-plate 96. Secured to the front end of the rear section is a mating hinge plate 100. A removable hinge pin 106 can be inserted through the aligned hinges of plate 96 and plate 100 to allow for the front and rear sections to be separated or connected.

OBJECTS AND ADVANTAGES

The preferred embodiment and various modifications thus described clearly shows the advantages of the articulated two-section snowboard. First of all, in downhill movement, it will be clear in the irregularity of the terrain, the engagement of surface with this variation of the articulated two-section snowboard will be facilitated because it is not dependent on the inflexibility of a monolithic snowboard.

Figure 6:
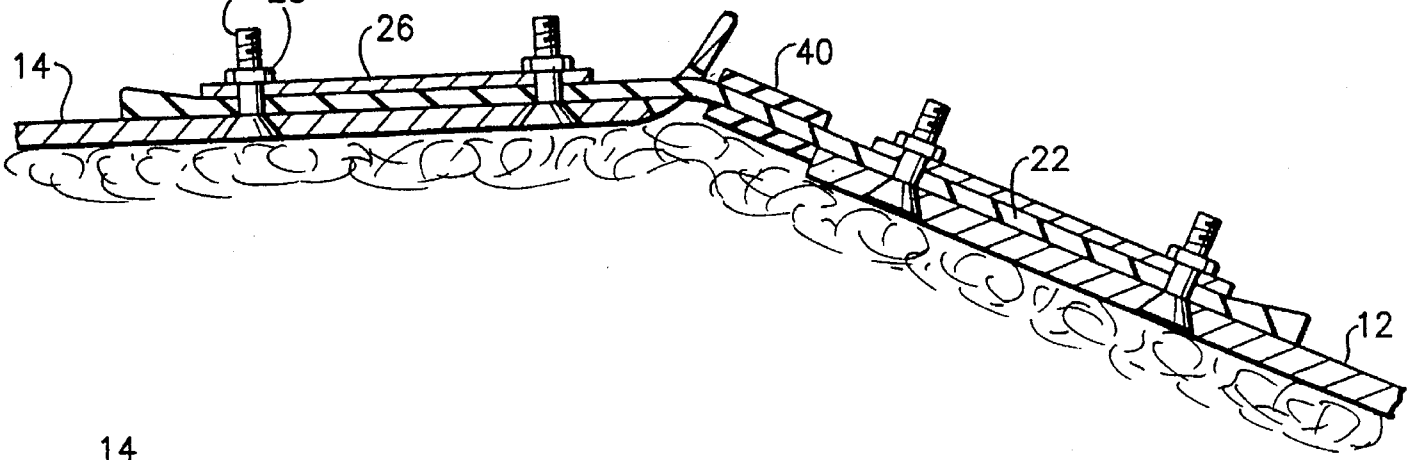
FIG. 6 is a sectional view comparable to FIG. 4, but showing fragmentarily in section the articulated two-section snowboard as it would appear going over a mogul or other uneven surface.

In FIG. 6 it is clear that at all times, regardless of the terrain conditions, this articulated two-section snowboard will provide better surface to ground contact, allowing the snowboarder greater control and agility. In addition to all this, in the field of acrobatic or stunt snowboarding, a new dimension is opened, whereby the snowboard, in the air or on the surface, can be articulated in various free form style displays.

Figure 12:
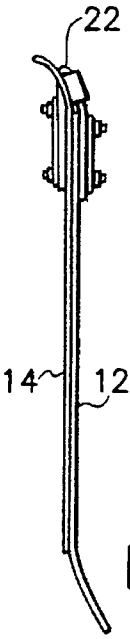
FIG. 12 is a side view of a articulated two-section snowboard, as shown in FIG. 1, folded for compact storage or transport.

In storage and transport, because the articulated two-section snowboard can be folded as shown in FIG. 12, the snowboard occupies less space in a vehicle, closet or storage area. The hinge-like of the articulated two-section snowboard will accommodate the snowboarder and co-occupant on a chair lift, whereas previous snowboards, due to the rigidity, tended to angle into the skis of the co-occupant. This current invention allows the articulated two-section snowboard to simply hang off of the foot bar of the chair lift, preventing interference and annoyance of both snowboarder and co-occupant when being transported on a chair lift. Prior rigid snowboards have been cumbersome in the event of a fall, whereas the foot in the rear binding must be unclipped for the user to be able to return to an upright position and then re-clipped to resume movement. The articulated two-section snowboard, due to the flexibility of its jointed parts, aides the user to return to an upright position in the event of a fall without having to unclip the rear boot attached to the rear binding.

Another cumbersome feature to the prior rigid snowboards is once a user reaches the bottom of a slope or a flat surface, forward movement is nearly impossible. The rear binding must be unclipped in prior snowboards, to allow the user to remove their boot from the binding and utilize the foot in order for forward motion to occur on flat surface. The articulated two section snowboard eliminates the requirement of having to unclip and re-clip when on a flat surface. The flexibility of the two sections allows the user to walk in a duck-like fashion. In the embodiment utilizing a quick-connect and disconnect feature, the user would simply remove a hinge pin, therefore saving extensive wear on the bindings and boots. By removing a hinge pin, the user would simply ski, utilizing the two-sections, now separate. The benefits of the articulated two-section snowboard are numerous.

While the above mentioned specifications are directed to a snowboard, it should be clear that the same structure and characteristics can be used for alternative mediums such as water, land and air. As a sole water ski, the present invention has many of the same benefits that can be utilized on a surface of water. The invention can also accommodate the same principals that previous skateboards contain with the structure of this invention relating the two sections. The same can apply for the apparatus utilized in air acrobatics.

Variations in the invention are possible. Thus, while the articulated two-section snowboard has been shown in only one embodiment, it is not limited, but is of a scope defined by the following claim language which may be broadened by an extension of the right to exclude others from making, using or selling the invention as is appropriate under the doctrine of equivalents.

What is claimed:

1. A snowboard comprising a front section, a rear section, a bi-ended flexible connector for flexibly connecting the front and rear sections together, and a binding for one foot mounted on each section, wherein the rear section has an upwardly curved tip, wherein the upwardly curved tip of the rear section is formed with an opening dimensioned to pass the connector therethrough, wherein one end of the flexible connector is secured to the rear section, and wherein the other end of the flexible connector passes through the opening formed in the rear section and is secured to the front section.

2. A snowboard comprising a front section, a rear section, at least two bi-ended flexible connectors for flexibly connecting the front and rear sections together, and a binding for one foot mounted on each section, wherein the rear section has an upwardly curved tip, wherein the upwardly curved tip of the rear section is formed with at least two openings, each opening being dimensioned to pass a respective flexible connector therethrough, wherein one end of each flexible connector is secured to the rear section, and wherein the other end of each flexible connector passes through a respective opening of the rear section and is secured to the front section.

* * * * *